US007810745B2

(12) United States Patent
Oomura et al.

(10) Patent No.: US 7,810,745 B2
(45) Date of Patent: Oct. 12, 2010

(54) NOZZLE DEVICE AND FUEL INJECTION VALVE HAVING THE SAME

(75) Inventors: Hidekazu Oomura, Hekinan (JP); Masanori Miyagawa, Kariya (JP)

(73) Assignee: Denso Corporation, Kariya (JP)

( * ) Notice: Subject to any disclaimer, the term of this patent is extended or adjusted under 35 U.S.C. 154(b) by 221 days.

(21) Appl. No.: 11/967,794

(22) Filed: Dec. 31, 2007

(65) Prior Publication Data

US 2008/0169367 A1 Jul. 17, 2008

(30) Foreign Application Priority Data

Jan. 12, 2007 (JP) ..... 2007-004354

(51) Int. Cl.
*B05B 1/00* (2006.01)

(52) U.S. Cl. ..... 239/596; 239/552; 239/556; 239/558; 239/585.1; 239/585.5; 123/305

(58) Field of Classification Search ..... 239/556–558, 239/560, 561, 585.1, 585.4, 585.5, 533.12, 239/552, 596; 123/299, 305
See application file for complete search history.

(56) References Cited

U.S. PATENT DOCUMENTS 6,089,476 A 7/2000 Sugimoto et al.
6,186,418 B1 2/2001 Tani
6,439,484 B2 * 8/2002 Harata et al. ..... 239/596
6,974,095 B2 * 12/2005 Harata et al. ..... 239/596
7,032,566 B2 * 4/2006 Cavanagh et al. ..... 239/533.12
7,100,848 B2 * 9/2006 Kobayashi et al. ..... 239/596
7,216,624 B2 * 5/2007 Mizobuchi et al. ..... 123/305

FOREIGN PATENT DOCUMENTS

EP 1 316 697 6/2003
JP 2000-104647 4/2000
JP 2005-264757 9/2005

OTHER PUBLICATIONS

Japanese Office Action dated Nov. 19, 2008 for corresponding Japanese Application No. 2007-004354, w/English Translation.

* cited by examiner

*Primary Examiner*—Steven J Ganey
(74) *Attorney, Agent, or Firm*—Nixon & Vanderhye PC

(57) ABSTRACT

A nozzle device has a nozzle holes for injecting sprays grouped into spray groups respectively in injection directions. The nozzle device has an injection axis extending through the center in the thickness direction thereof. The injection axis perpendicularly intersects with an imaginary plane, which is at a predetermined distance from the nozzle device. The nozzle holes respectively have passage axes from which imaginary lines are respectively extended. The imaginary plane and the imaginary lines therebetween have intersections respectively defining outer intersections and an inner intersection in at least one of the spray groups. Each of the nozzle holes is inclined at an inclination angle being determined in such a manner that: the outer intersections exist in a polygon or a circle, and the inner intersection exists inside the outer intersections.

16 Claims, 11 Drawing Sheets

NOZZLE DEVICE AND FUEL INJECTION VALVE HAVING THE SAME

CROSS REFERENCE TO RELATED APPLICATIONS

This application is based on and incorporates herein by reference Japanese Patent Application No. 2007-4354 filed on Jan. 12, 2007.

FIELD OF THE INVENTION

The present invention relates to a nozzle device having nozzle holes. The present invention further relates to a fuel injection valve having the nozzle device.

BACKGROUND OF THE INVENTION

For example, U.S. Pat. No. 6,186,418 B1 (JP-A-2000-104647) proposes a fuel injection valve having a plate-shaped nozzle device defining therein multiple nozzle holes for injecting fuel being grouped and injected in two directions. In the nozzle device having multiple nozzle holes, atomization of fuel spray is promoted as the diameter of each nozzle hole becomes small. The number of the nozzle holes in the nozzle device need to be increased to maintain predetermined injection quantity when the diameter of the nozzle hole becomes small and the injection quantity from each nozzle hole decreases.

However, since spread angles of sprays and a spread angle of one spray are determined according to each specific performance, the spread angles of the sprays and the spread angle of the one spray itself are constant, even when the number of the nozzle holes increases, As shown in FIG. 16, an imaginary straight line extends in an injection direction along a passage axis of each of nozzle holes 400, 402. That is, the imaginary straight line extends along an extension line each inclined by an angle of inclination of each of the nozzle holes. The imaginary straight lines and an imaginary plane therebetween define intersections 412 on a polygon or a circle. In the present spraying shape, the distance between the intersections 412 adjacent to each other becomes small as the number of the nozzle holes increases in each spray 410 in the two-direction fuel injections. As a result, fuel sprays respectively injected from nozzle holes interfere with each other, and consequently, atomization of the fuel sprays are impaired.

Furthermore, since the intersections 412 are located on the polygon or the circle, an injection quantity of the spray 410 is varied. Specifically, the injection quantity becomes large on the polygon or the circle, on which the intersections 412 are located, and an injection quantity becomes small in the radially inside of the intersection 412. Therefore, deviation in distribution of the injection quantity becomes large in the spray 410.

In addition, as shown in FIG. 17, the imaginary straight lines, each of which extends in the injection direction along the passage axis of each of nozzle holes 420, 422, and an imaginary plane therebetween define intersections 432 on a polygon, which is inwardly dented. Even in the present spraying shape, the distance between the intersections 432 adjacent to each other becomes small as the number of the nozzle holes increases in each spray 430 in the two-direction fuel injections. Consequently, atomization of the fuel sprays is impaired, and deviation in distribution of the injection quantity becomes large.

When atomization of the fuel spray is impaired and deviation in distribution of injection quantity becomes large, mixture of fuel and the air becomes insufficient and hence, unburnt components such as HC increase in the exhaust gas.

SUMMARY OF THE INVENTION

In view of the foregoing problems, it is an object of the present invention to produce a nozzle device being capable of promoting atomization and reducing deviation in distribution of injection quantity. It is another object of the present invention to produce a fuel injection valve having the nozzle device.

According to one aspect of the present invention, a nozzle device is substantially in a plate-shape, the nozzle device comprising a nozzle portion having a plurality of nozzle holes for injecting a plurality of sprays grouped into a plurality of spray groups respectively injected in injection directions different from each other. The nozzle portion has an injection axis extending through a center of the nozzle portion in a thickness direction of the nozzle portion. The injection axis perpendicularly intersects with an imaginary plane, which is at a predetermined distance from the nozzle portion in the injection directions. The plurality of nozzle holes respectively have passage axes from which imaginary lines are respectively extended in the injection directions. The imaginary plane and the imaginary lines therebetween have intersections respectively defining a plurality of outer intersections and at least one inner intersection in at least one of the plurality of spray groups. Each of the plurality of nozzle holes is inclined at an inclination angle being determined in such a manner that: the plurality of outer intersections exist in a first polygon, which is outwardly convex, or a first circle, and the at least one inner intersection exists inside the plurality of outer intersections.

According to another aspect of the present invention, a fuel injection valve comprises a valve body having an inner periphery defining a fuel passage and a valve seat. The fuel injection valve further comprises a valve element adapted to blocking the fuel passage by being seated to the valve seat and adapted to opening the fuel passage by being lifted from the valve seat. The fuel injection valve further comprises a nozzle device being substantially in a plate-shape and provided downstream of the valve seat for injecting fuel flowing out of the fuel passage. The nozzle device includes a nozzle portion having a plurality of nozzle holes for injecting a plurality of sprays grouped into a plurality of spray groups respectively injected in injection directions different from each other. The nozzle portion has an injection axis extending through a center of the nozzle portion in a thickness direction of the nozzle portion. The injection axis perpendicularly intersects with an imaginary plane, which is at a predetermined distance from the nozzle portion in the injection directions. The plurality of nozzle holes respectively have passage axes from which imaginary lines are respectively extended in the injection directions. The imaginary plane and the imaginary lines therebetween have intersections respectively defining a plurality of outer intersections and at least one inner intersection in at least one of the plurality of spray groups. Each of the plurality of nozzle holes is inclined at an inclination angle being determined in such a manner that: the plurality of outer intersections exist in a first polygon, which is outwardly convex, or a first circle, and the at least one inner intersection exists inside the plurality of outer intersections.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1A:
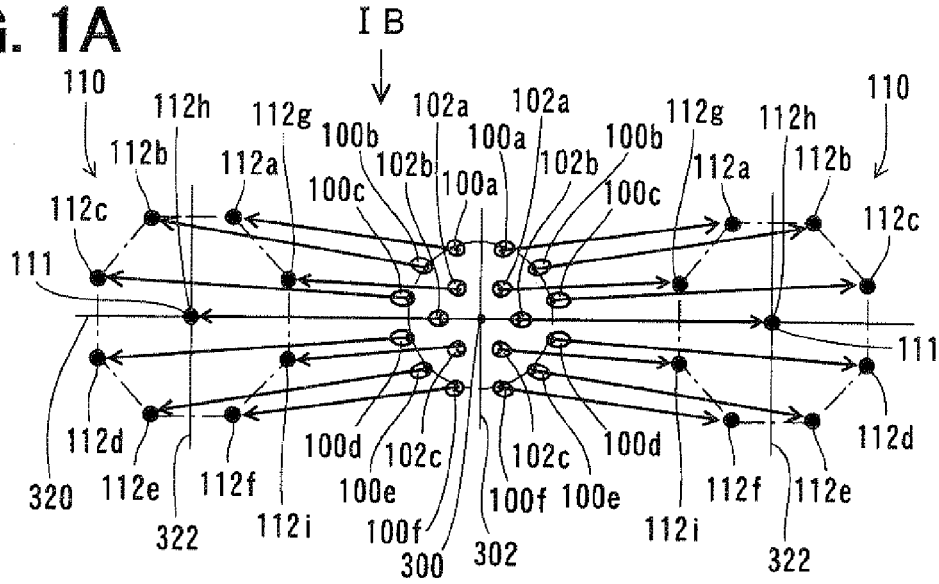
FIG. 1A is a view showing a nozzle plate when being viewed from outside injection nozzle holes according to a first embodiment.

As shown in FIG, 3, a nozzle device of the first embodiment is provided to a fuel injection valve of a gasoline engine, for example. A fuel injection valve 10 is provided to an intake pipe for injecting fuel in two directions respectively toward two intake valves, each opens and closes an intake port of a combustion chamber of the engine.

The fuel injection valve 10 includes a casing 10 molded of resin to cover a magnetic pipe 14, a stationary core 50, a coil 62, and the like. The coil 62 is wound around a spool 60. The magnetic pipe 14 is joined with a valve body 16 by laser welding or the like. A nozzle needle 30 as a valve element is axially movable in the magnetic pipe 14 and the valve body 16. The nozzle needle 30 is capable of being seated to a valve seat 18 at a contact portion 32. The valve seat 18 is formed in an inner periphery 17 of the valve body 16, The inner periphery 17 of the valve body 16 defines a fuel passage 70 substantially in a conical shape. The fuel passage 70 is reduced in diameter toward the downstream.

A tip end surface of the nozzle needle 30 and an end surface of a nozzle plate 20 on the side of the fuel inlet therebetween define a fuel chamber being flat and substantially in a circular shape. The nozzle needle 30 is connect with a movable core 40 at a connected portion 34 on the opposite side of the contact portion 32. The stationary core 50 is joined with a nonmagnetic pipe 52, and the nonmagnetic pipe 52 is joined with the magnetic pipe 14 by laser welding or the like.

The nozzle plate 20 as a nozzle device being in a thin disc shape is arranged downstream of the valve body 16. The nozzle plate 20 is in contact with a bottom outer wall surface of the valve body 16, and is bonded with the valve body 16 by laser welding. As shown in FIG. 1A, the nozzle plate 20 has a total of twelve nozzle holes including two of each nozzle hole 100*a*, 100*b*, 100*c*, 100*d*, 100*e*, 100*f* arranged on an outer circumference around an injection axis 300 as a center. The injection axis 300 passes along the center of the nozzle plate 20 in the thickness direction. The nozzle plate 20 further has a total of six nozzle holes including two of each nozzle hole 102*a*, 102*b*, 102*c* on an inner circumference on the inner side of the outer circumference. That is, the nozzle plate 20 has a total of eighteen nozzle holes. A total of nine nozzle holes including the nozzle holes 100*a*, 100*b* 100*c*, 100*d*, 100*e*, 100*f* and the nozzle holes 102*a*, 102*b*, 102*c* are grouped. Two groups of the nine nozzle holes are respectively arranged on both sides with respect to a straight line, which passes along the injection axis 300. As shown in the FIG. 1A the nozzle holes of the same reference numerals in the two nozzle hole groups are arranged substantially in axisymmetric positions relative to a straight line 302, which passes through the injection axis 300. Each of the eighteen nozzle holes inclines to be away from the injection axis 300 as each nozzle hole goes in the direction of the fuel injection. That is, each nozzle hole inclines to be away from the injection axis 300 downstream along the fuel injection. Fuel is injected from the two groups of the nozzle holes defined in two directions in such a manner, thereby forming two groups of sprays 110. The injection axis 300 of the nozzle plate 20 is also the center axis of the portion where the eighteen nozzle holes are defined in the nozzle plate 20.

Figure 3:
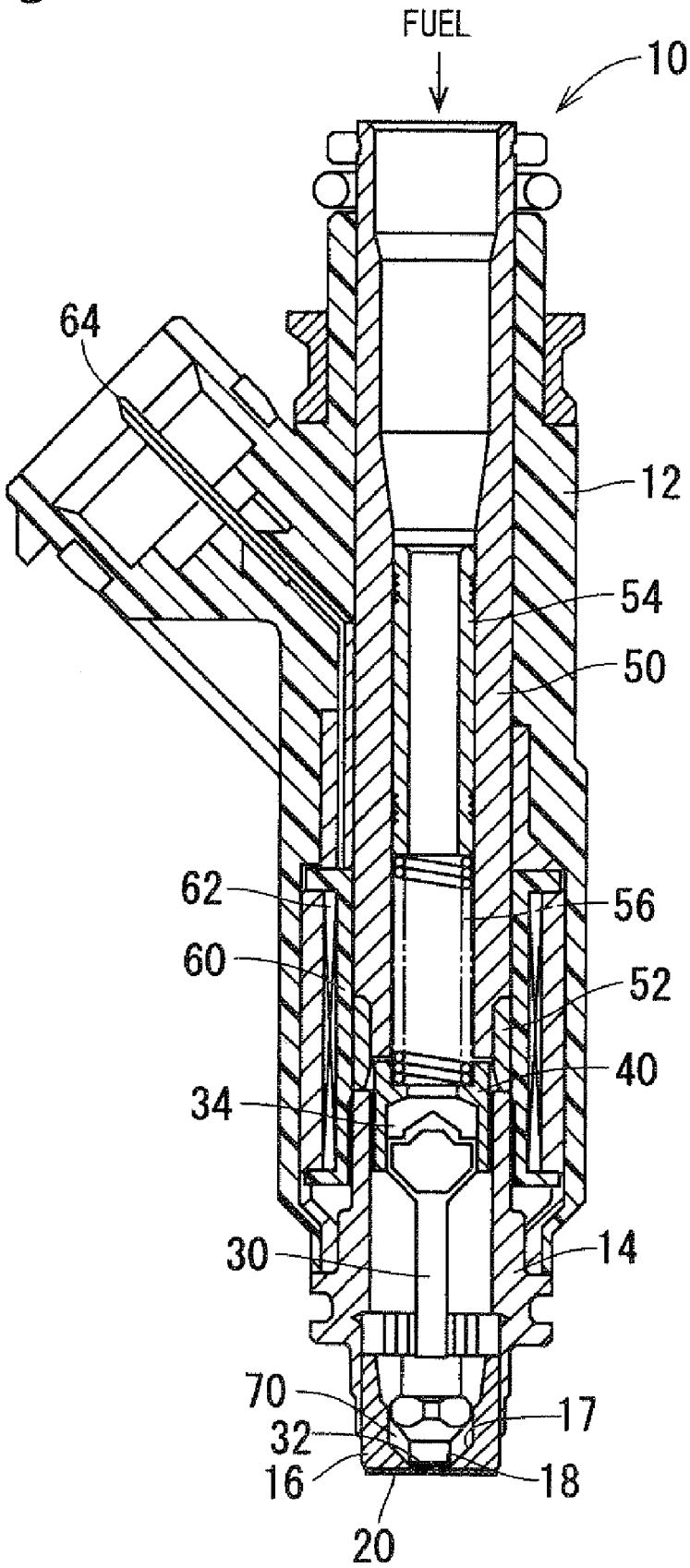
FIG. 3 is a sectional view showing a fuel injection valve according to the first embodiment.

As shown in FIG. 3, an adjusting pipe 54 is press-fitted in the stationary core 50. A spring 56 is in contact with the movable core 40 at one end, and is in contact with the adjusting pipe 54 at the other end. Load of the spring 56 applied to the movable core 40 is controlled by adjusting the press-fitting of the adjusting pipe 54 relative to the stationary core 50.

The spool 60 surrounds the outer peripheries of the magnetic pipe 14, the stationary core 50, and the nonmagnetic pipe 52. The coil 62 is wound around the spool 60, and is electrically connected with a terminal 64 through which a driving current is supplied.

Next, the nozzle holes defined in the nozzle plate 20 and the fuel sprays from the nozzle holes are described in detail.

Figure 1B:
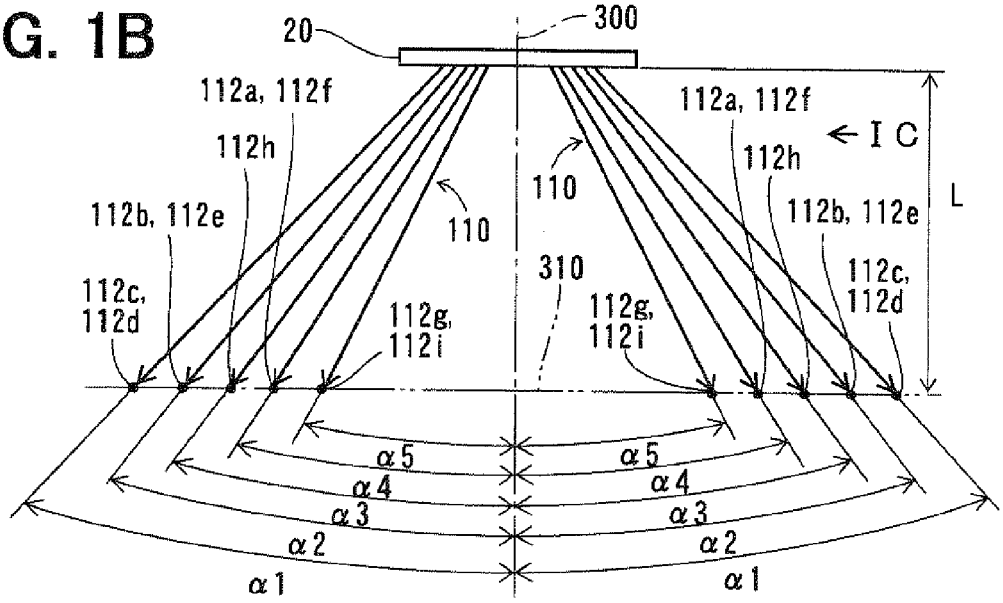
FIG. 1B is a view showing a front side of the nozzle plate when being viewed from the arrow IB in FIG. 1A.
Figure 1C:
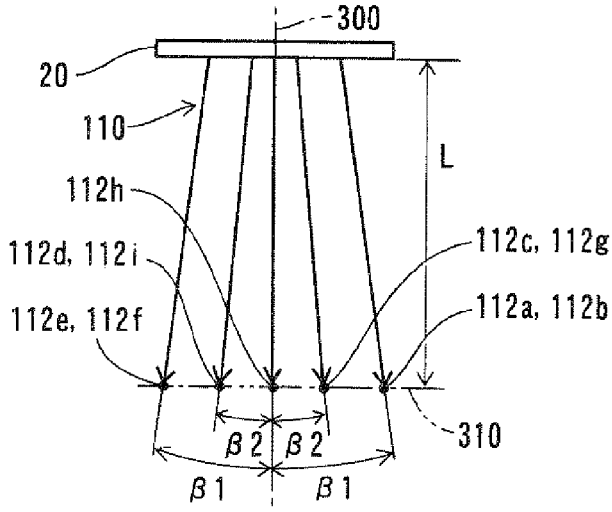
FIG. 1C is a view showing a lateral side of the nozzle plate when being viewed from the arrow IC in FIG. 1B.

As shown in FIGS. 1A to 1C, fuel is injected from the grouped nozzle holes 100*a*, 100*b*, 100*c*, 100*d*, 100*e*, 100*f*, 102*a*, 102*b*, 102*c* to form two-way sprays 110. Imaginary straight lines extend respectively along passage axes of the nozzle holes 100*a*, 100*b*, 100*c*, 100*d*, 100*e*, 100*f*, 102*a*, 102*b*, 102*c* in the direction of fuel injection forming the spray 110. The imaginary straight lines are shown by the arrows extending respectively from the nozzle holes in FIGS. 1A to 1C, and each being equivalent to an extension line of each nozzle hole along the angle of inclination (inclination angle) of each nozzle hole. An imaginary plane 310 is distant from the nozzle plate 20 by a predetermined distance (L) in the injection axis 300 along the direction of the fuel injection, and intersects perpendicularly to the injection axis 300. The imaginary plane 310 and the imaginary straight lines have therebetween intersections 112*a*, 112*b*, 112*c*, 112*d*, 112*e*, 112*f*, 112*g*, 112*h*, 112*i*. The intersections 112*a*, 112*b*, 112*c*, 112*d*, 112*e*, 112*f*, 112*g*, 112*i* are located on vertexes of a substantially right octagon. The intersection 112*h* is located at a center 111 inside the substantially right octagon defined by the intersections 112*a*, 112*b*, 112*c*, 112*d*, 112*e*, 112*f*, 112*g*, 112*i*. In the first embodiment, the center 111 is also substantially the center of the spray 110. The intersections 112*a*, 112*b*, 112*c*,112*d*, 112*e*, 112*f*, 112*g*, 112*i* define outer intersections, and the intersection 112*h* defines an inner intersection.

The distance among the eighteen nozzle holes as arranged in the above manner, the symmetry of the eighteen nozzle holes, and the fuel spray injected from the nozzle holes are described through the following clauses (1) to (4).

(1) As shown in FIG. 2, in the intersections 112*a*, 112*b*, 112*c*, 112*d*, 112*e*, 112*f*, 112*g*, 112*i* located on the vertexes of the substantially right octagon, the distance between the intersections, which are circumferentially adjacent to each other, is substantially uniform. The number of the outer intersections including the intersections 112*a*, 112*b*, 112*c*, 112*d*, 112*e*, 112*f*, 112*g*, 112*i* is eight, and the number of the inner intersection including the intersection 112*h* is one. That is, in the first embodiment, the number of the outer intersections is eight times that of the inner intersection. The distance between the intersection 112*h* as the inner intersection and each of the intersections 112*a*, 112*b*, 112*c*, 112*d*, 112*e*, 112*f*, 112*g*, 112*i* as the outer intersections is substantially uniform.

Figure 2A:
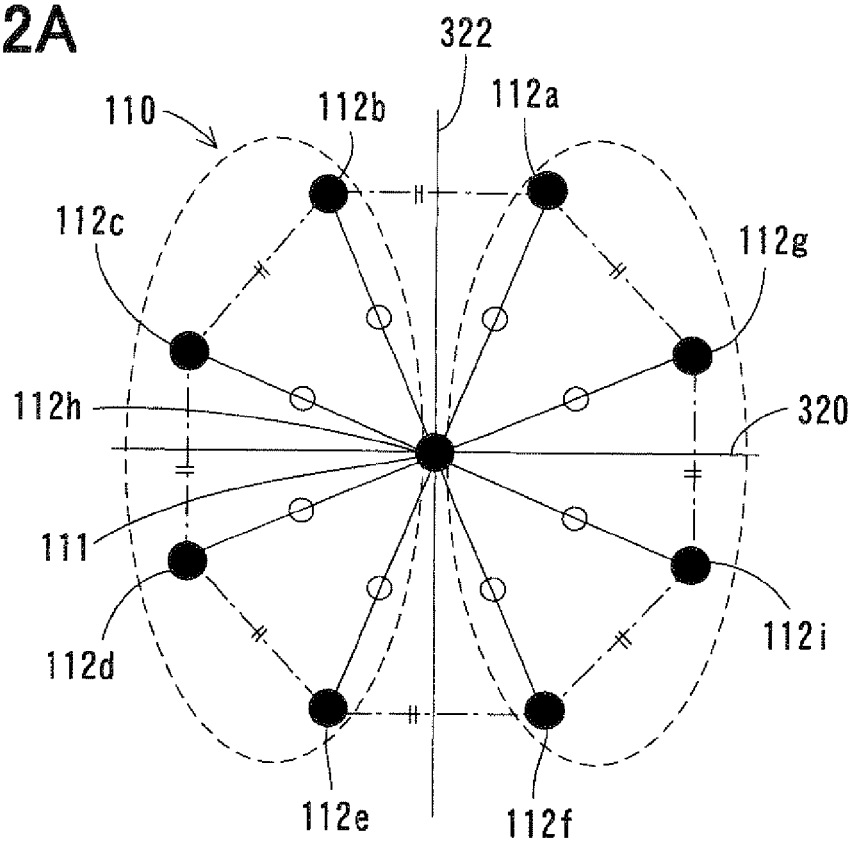
FIGS. 2A, 2B are views each showing positions of intersections between an imaginary plane and passage axes of the nozzle holes, according to the first embodiment.

(2) As shown in FIG. 2A, intercentral lines 320 respectively pass through the centers of the two groups of the sprays 110. An orthogonal line 322 intersects perpendicularly to the intercentral lines 320. The orthogonal line 322 passes through the centers 111 of the substantially right octagons defined by the intersections 112*a*, 112*b*, 112*c*, 112*d*, 112*e*, 112*f*, 112*g*, 112*i* as the outer intersections. The orthogonal line 322 is substantially in parallel with the imaginary plane 310. The intersections 112*b*, 112*c*, 112*d*, 112*e* and the intersections 112*a*, 112*g*, 112*i*, 112*f* are substantially axisymmetric to each other with respect to the orthogonal line 322.

Figure 2B:
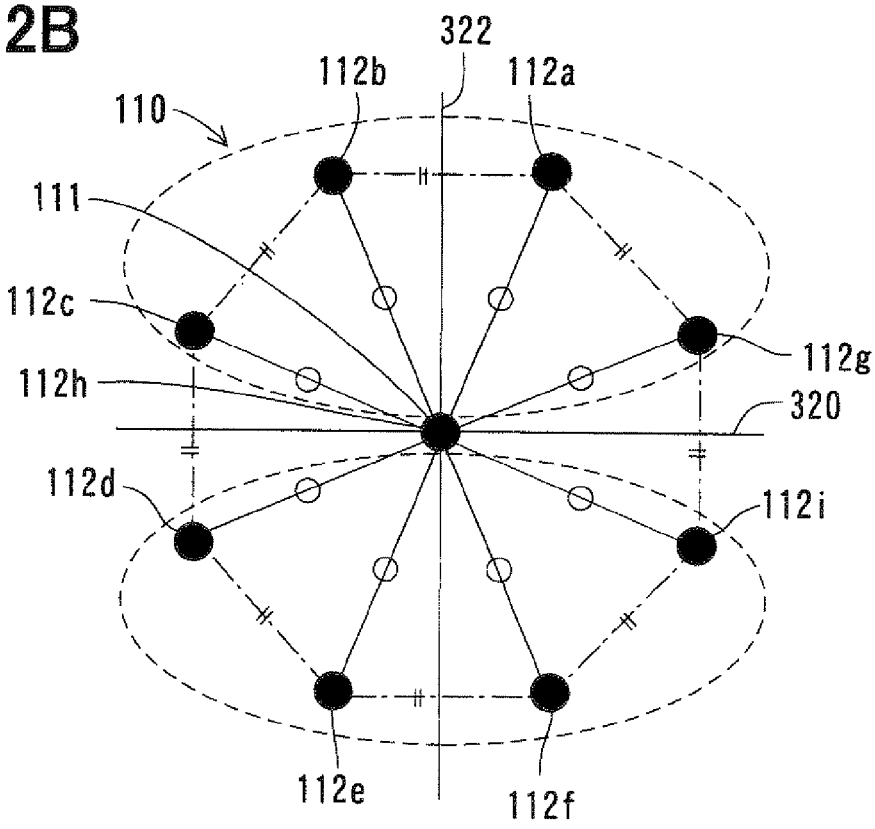

As shown in FIG. 2B, the intersections 112*c*, 112*b*, 112*a*, 112*g* and the intersections 112*d*, 112*e*, 112*f*, 112*i* are substantially axisymmetric to each other with respect to the intercentral line 320.

The intersections 112*a*, 112*b*, 112*c*, 112*d*, 112*e*, 112*f*, 112*g*, 112*i* are located on the vertexes of the substantially right octagon. The intersection 112*h* is located inside the substantially right octagon. The inclination angle of each nozzle hole is determined such that each intersection is arranged at the position defined by the above clauses (1) and (2). Thus, the fuel sprays injected from the nozzle holes can be restricted from interfering with each other. Thereby, atomization of the fuel spray can be promoted. Furthermore, the spray 110 can be uniformly distributed on the imaginary plane 310 in injection quantity, without being unbalanced.

(3) FIG. 1B shows a front side when being viewed perpendicularly to the intercentral line 320 and being viewed along the imaginary plane 310. When the spray 110 is viewed from the front side in FIG. 1B, each of the intersections 112*c*, 112*d* intersects with the imaginary plane 310 substantially at the same position and the intersections 112*c*, 112*d* are grouped together into one intersection group. Similarly, the intersections 112*b*, 112*e*, the intersection 112*h*, the intersections 112*a*, 112*f*, and the intersections 112*g*, 112*i* are also grouped together respectively into intersection groups. When the spray 110 is viewed from the front side in FIG. 1B, the extension line of each passage axis shown by the arrow extends from each nozzle hole along the direction of fuel injection. The extension line corresponding to each intersection group extends along the direction of fuel injection and inclines at an inclination angle. The inclination angle becomes large as the intersection group becomes distant from the injection axis 300. The intersections 112*c*, 112*d* are most distant from the injection axis 300, and the intersections 112*g*, 112*i* are the closest to the injection axis 300. The distance from the injection axis 300 becomes less in the order of the intersections 112*c*, 112*d*, the intersections 112*b*, 112*e*, the intersection 112*h*, the intersections 112*a*, 112*f*, and the intersections 112*g*, 112*i*. That is, the intersections 112*c*, 112*d* are most distant from the injection axis 300. The intersections 112*g*, 112*i* are in the most vicinity of the injection axis 300.

The passage axes of the nozzle holes corresponding to the intersections 112*c*, 112*d* are inclined relative to the injection axis 300 at an inclination angle $\alpha 1$. The passage axes of the nozzle holes corresponding to the intersections 112*b*, 112*e* are inclined relative to the injection axis 300 at an inclination angle $\alpha 2$. The passage axis of the nozzle hole corresponding to the intersection 112*h* is inclined relative to the injection axis 300 at an inclination angle $\alpha 3$. The passage axes of the nozzle holes corresponding to the intersections 112*a*, 112*f* are inclined relative to the injection axis 300 at an inclination angle $\alpha 4$. The passage axes of the nozzle holes corresponding to the intersections 112*g*, 112*i* are inclined relative to the injection axis 300 at an inclination angle $\alpha 5$. The $\alpha 1$ to $\alpha 5$ have the relationship of: $\alpha 1>\alpha 2>\alpha 3>\alpha 4>\alpha 5$. The inclination angles $\alpha 1$ to $\alpha 5$ respectively corresponding to the intersection groups are not necessarily the same in each group, and the values of the inclination angles may vary in each group within a specific range such that the inclination angles satisfy; $\alpha 1>\alpha 2>\alpha 3>\alpha 4>\alpha 5$. The values of differences between the inclination angles of adjacent passage axes are substantially uniform when being viewing from the front side shown in FIG. 1B. That is, the values of differences have the relationship: $\alpha 1-\alpha 2 \div \alpha 2-\alpha 3 \div \alpha 3-\alpha 4 \div \alpha 4-\alpha 5$.

(4) FIG. 1C shows a lateral side when being viewed along the intercentral line 320. When the spray 110 is viewed from the lateral side in FIG. 1C, each of the intersections 112*a*, 112*b* intersects with the imaginary plane 310 substantially at the same position and the intersections 112*a*, 112*b* are grouped together into one intersection group. Similarly, the intersections 112*e*, 112*f*, the intersections 112*c*, 112*g*, the intersections 112*d*, 112*i*, and the intersection 112*h*are also grouped together respectively into insertion groups. When the spray 110 is viewed from the lateral side in FIG. 1C, the extension line of each passage axis shown by the arrow extends from each nozzle hole along the direction of fuel injection. The extension line corresponding to each intersection group extends along the direction of fuel injection and inclines at an inclination angle. The inclination angle becomes large as the intersection group becomes distant from the injection axis 300.

The intersections 112*a*, 112*b* and intersections 112*e*, 112*f* are distant from the injection axis 300 further than the intersections 112*c*, 112*g* and the intersections 112*d*, 112*i*. The passage axes of the nozzle holes corresponding to the intersections 112*a*, 112*b* and the passage axes of the nozzle holes corresponding to the intersections 112*e*, 112*f* are inclined relative to the injection axis 300 substantially at the same inclination angle β1. The passage axes of the nozzle holes corresponding to the intersections 112*c*, 112*g* and the passage axes of the nozzle holes corresponding to the intersections 112*d* 112*i* are inclined relative to the injection axis 300 substantially at the same inclination angle β2. The β1 and the β2 have the relationship of: β1>β2. The extension of the passage axis of the nozzle hole corresponding to the intersection 112*h*substantially coincides with the injection axis 300 when being viewed from the lateral side in FIG. 1C, and therefore, the inclination angle of the intersection 112*h* relative to the injection axis 300 is substantially 0 degree. The values of differences between the inclination angles of adjacent passage axes are substantially uniform when being viewing from the lateral side shown in FIG. 1C.

The fuel sprays can be restricted from crossing and interfering with each other by determining the inclination angle of fuel spray injected from each nozzle hole, as described in the clauses (3) and (4). Thereby, atomization of the fuel spray can be promoted.

In present embodiment, atomization of fuel spray can be promoted and distribution of injection quantity can be uniformed by employing the structures described in the clauses (1) to (4). Thus, mixture of fuel spray and air can be enhanced, and unburnt components such as HC can be reduced from exhaust gas.

Second Embodiment

The second embodiment is described with reference to FIGS. 4, 5. In the second embodiment, the structure of the fuel injection valve other than a nozzle plate 80 is substantially the same as the structure in the first embodiment.

Figure 4A:
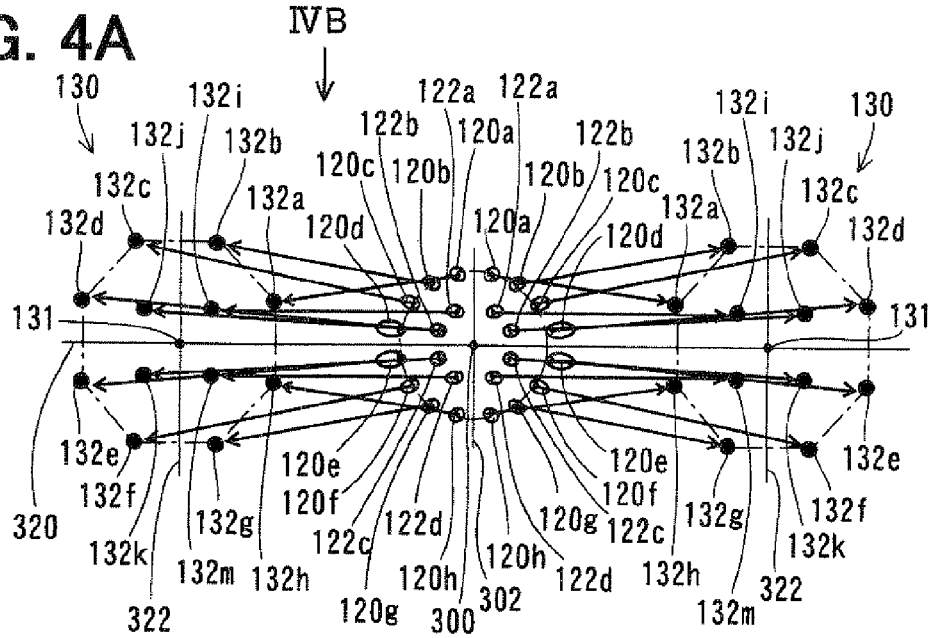
FIG. 4A is a view showing a nozzle plate when being viewed from outside injection nozzle holes according to a second embodiment.

As shown in FIG. 4A, the nozzle plate 80 has a total of sixteen nozzle holes including two of each nozzle hole 120*a*, 120*b*, 120*c*, 120*d*, 120*e*, 120*f*, 120*g*, 120*h* arranged on the outer circumferential periphery around the injection axis 300 as a center. The nozzle plate 80 further has a total of eight nozzle holes including two of each nozzle hole 122*a*, 122*b*, 122*c*, 122*d* on an inner circumference on the inner side of the outer circumference That is, the nozzle plate 80 has a total of twenty-four nozzle holes. A total of twelve nozzle holes including the nozzle holes 120*a*, 120*b*, 120*c*, 120*d*, 120*e*, 120*f*, 120*g*, 120*h* and the nozzle holes 122*a*, 122*b*, 122*c*, 122*d* are grouped. Two groups of the twelve nozzle holes are respectively arranged on both sides with respect to a straight line, which passes along the injection axis 300. As shown in the FIG. 4A, the nozzle holes of the same reference numerals in the two nozzle hole groups are arranged substantially in axisymmetric positions relative to the straight line 302, which passes through the injection axis 300. Each of the twenty-four nozzle holes inclines to be away from the injection axis 300 as each nozzle hole goes in the direction of the fuel injection. That is, each nozzle hole inclines to be away from the injection axis 300 downstream along the fuel injection. Fuel is injected from the two groups of the nozzle holes defined in two directions in such a manner, thereby forming two groups of sprays 130.

Next, the nozzle plate 80 and the fuel sprays from the nozzle holes are described in detail.

As shown in FIG. 4, fuel is injected from the grouped nozzle holes 120*a*, 120*b*, 120*c*, 120*d*, 120*e*, 120*f*, 120*g*, 120*h*, 122*a*, 122*b*, 122*c*, 122*d* to form tow-way sprays 130. Imaginary straight lines extend respectively along passage axes of the nozzle holes 120*a*, 120*b*, 120*c*, 120*d*, 120*e*, 120*f*, 120*g*, 120*h*, 122*a*, 122*b*, 122*c*, 122*d* in the direction of fuel injection forming the spray 130. The imaginary straight lines are shown by the arrows extending respectively from the nozzle holes in FIGS. 1A to 1C, and each being equivalent to an extension line of each nozzle hole along the inclination angle of each nozzle hole. The imaginary plane 310 is distant from the nozzle plate 20 by a predetermined distance (L) in the injection axis 300 along the direction of the fuel injection, and intersects perpendicularly to the injection axis 300. The imaginary plane 310 and the imaginary straight lines have therebetween intersections 132*a*, 132*b*, 132*c*, 132*d*, 132*e*, 132*f*, 132*g*, 132*h* 132*i*, 132*j*, 132*k*, 132*m*. The intersections 132*a*, 132*b*, 132*c*, 132*d*, 132*e*, 132*f*, 132*g*, 132*h* are located on vertexes of a substantially right octagon. The intersections 132*i*, 132*j*, 132*k*, 132*m* are located on a substantially perfect circle having the center 113 in common with that of the substantially right octagon defined by the intersections 132*a*, 132*b*, 132*c*, 132*d*, 132*e*, 132*f*, 132*g*, 132*h* and located inside the substantially right octagon. In the second embodiment, the center 131 is also substantially the center of the spray 130. The intersections 132*a*, 132*b*, 132*c*, 132*d*, 132*e*, 132*f*, 132*g*, 132*h* define outer intersections, and the intersections 132*i*, 132*j*, 132*k*, 132*m* defines an inner intersection.

The distance among the twenty-four nozzle holes as arranged in the above manner, the symmetry of the twenty-four nozzle holes, and the fuel spray injected from the nozzle holes are described through the following clauses (5) to (8).

(5) As shown in FIG. 5, in the intersections 132*a*, 132*b*, 132*c*, 132*d*, 132*e*, 132*f*, 132*g*, 132*h* located on the vertexes of the substantially right octagon, the distance between the intersections, which are circumferentially adjacent to each other, is substantially uniform. In the intersections 132*i*, 132*j*, 132*k*, 132*m* located on the same circle, the distance between the intersections, which are circumferentially adjacent to each other, is also substantially uniform.

The number of the outer intersections including the intersections 132*a*, 132*b*, 132*c*, 132*d*, 132*e*, 132*f*, 132*g*, 132*h* is eight, and the number of the inner intersections including the intersections 132*i*, 132*j*, 132*k*, 132*m* is four. That is, in the second embodiment, the number of the outer intersections is twice that of the inner intersection. The distance between the intersection 132*i* and the intersection 132*a* is substantially the same as the distance between the intersection 132*i* and the intersection 132*b*. The distance between the intersection 132*j* and the intersection 132*c* is substantially the same as the distance between the intersection 132*j* and the intersection

132*d*. The distance between the intersection 132*k* and the intersection 132*e* is substantially the same as the distance between the intersection 132*k* and the intersection 132*f*. The distance between the intersection 132*m* and the intersection 132*g* is substantially the same as the distance between the intersection 132*m* and the intersection 132*h*.

Figure 5A:
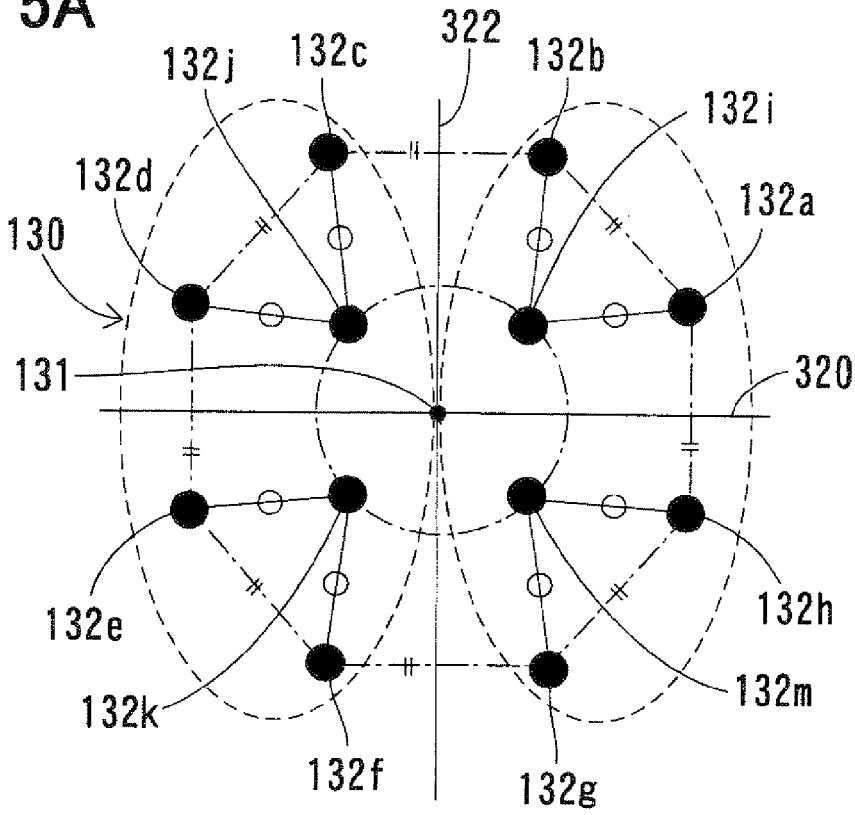
FIGS. 5A, 5B are views each showing positions of intersections between the imaginary plane and passage axes of the nozzle holes, according to the second embodiment.

(6) As shown in FIG. 5A, the intercentral lines 320 respectively pass through the centers of the two groups of the sprays 130. The orthogonal line 322 intersects perpendicularly to the intercentral lines 320. The orthogonal line 322 passes through the centers 131 of the substantially right octagons defined by the intersections 132*a*, 132*b*, 132*c*, 132*d*, 132*e*, 132*f*, 132*g*, 132*h* as the outer intersections. The orthogonal line 322 is substantially in parallel with the imaginary plane 310. The intersections 132*c*, 132*d*, 132*e*, 132*f*, 132*j*, 132*k*and the intersections 132*b*, 132*a*, 132*h* 132*g*, 132*i*, 132*m* are substantially axisymmetric to each other with respect to the orthogonal line 322.

Figure 5B:
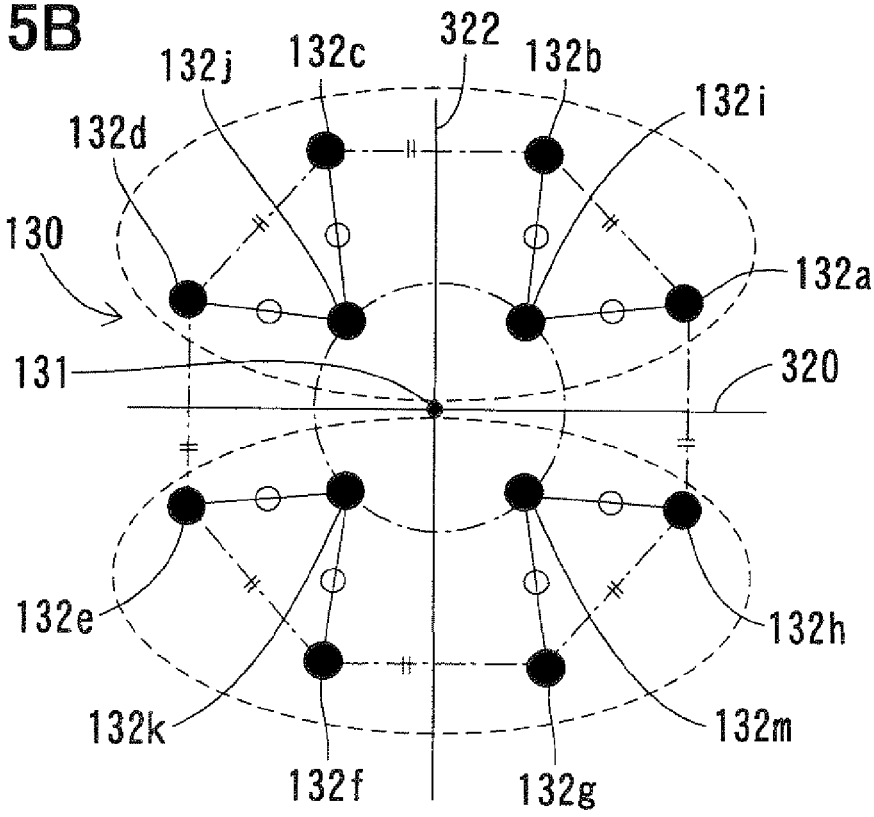

As shown in FIG. 5B, the intersections 132*d*, 132*c*, 132*b*, 132*a*, 132*j*, 132*i* and the intersections 132*e*, 132*f*, 132*g*, 132*h* 132*k*, 132*m* are substantially axisymmetric to each other with respect to the intercentral line 320.

The intersections 132*a*, 132*b*, 132*c*, 132*d*, 132*e*, 132*f*, 132*g*, 132*h*are located on the vertexes of the substantially right octagon. The intersections 132*i*, 132*j*, 132*k*, 132*m* are located on the substantially perfect circle inside the substantially right octagon. The inclination angle of each nozzle hole is determined such that each intersection is arranged at the position defined by the above clauses (5) and (6). Thus, the fuel sprays injected from the nozzle holes can be restricted from interfering with each other. Thereby, atomization of the fuel spray can be promoted. Furthermore, the spray 130 can be uniformly distributed on the imaginary plane 310 in injection quantity, without being unbalanced.

Figure 4B:
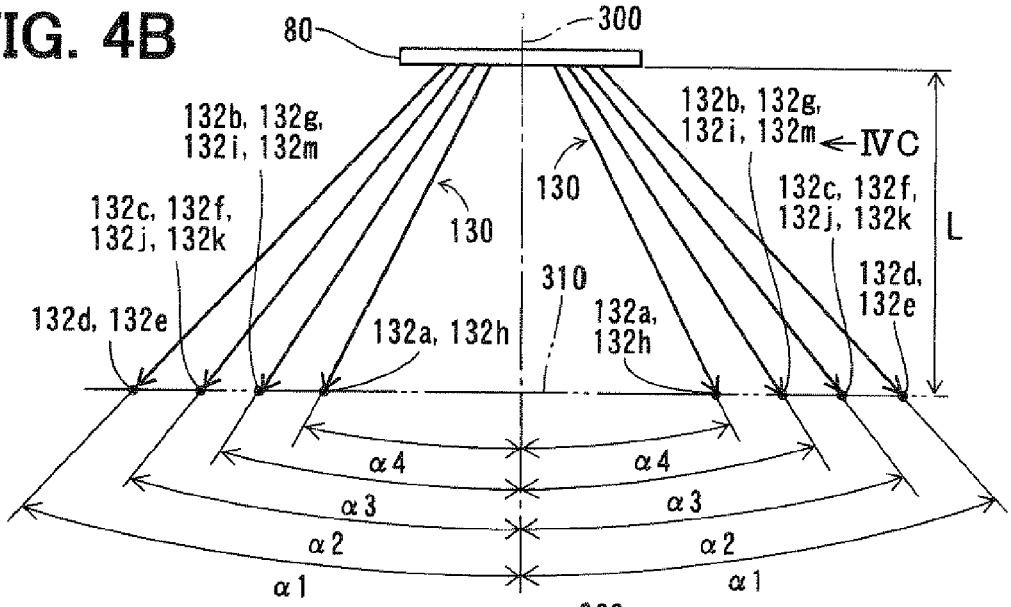
FIG. 4B is a view showing a front side of the nozzle plate when being viewed from the arrow IVB in FIG. 4A.

(7) FIG. 4B shows a front side when being viewed perpendicularly to the intercentral line 320 and being viewed along the imaginary plane 310. When the spray 130 is viewed from the front side in FIG. 4B, each of the intersections 132*d*, 132*e* intersect with the imaginary plane 310 substantially at the same position and are grouped together into one intersection group. Similarly, the intersections 132*c*, 132*f*, 132*j*, 132*k*, the intersections 132*b*, 132*g*, 132*i*, 132*m*, and the intersections 132*a*, 132*h* are also grouped together respectively into intersection groups. When the spray 130 is viewed from the front side in FIG. 4B, the extension line of each passage axis shown by the arrow extends from each nozzle hole along the direction of fuel injection. The extension line corresponding to each intersection group extends along the direction of fuel injection and inclines at an inclination angle. The inclination angle becomes large as the intersection group becomes distant from the injection axis 300. The intersections 132*d*, 132*e* are most distant from the injection axis 300, and the intersections 132*a*, 132*h* are the closest to the injection axis 300. The distance from the injection axis 300 becomes less in the order of the intersections 132*d*, 132*e*, the intersections 132*c*, 132*f*, 132*j*, 132*k*, the intersections 132*b*, 132*g*, 132*i*, 132*m*, and the intersections 132*a*, 132*h*. That is, the intersections 132*d*, 132*e* are most distant from the injection axis 300. The intersections 132*a*, 132*h* are in the most vicinity of the injection axis 300.

The passage axes of the nozzle holes corresponding to the intersections 132*d*, 132*e* are inclined relative to the injection axis 300 at an inclination angle $\alpha 1$. The passage axes of the nozzle holes corresponding to the intersections 132*c*, 132*f*, 132*j*, 132*k* are inclined relative to the injection axis 300 at an inclination angle $\alpha 2$. The passage axes of the nozzle holes corresponding to the intersections 132*b*, 132*g*, 132*i*, 132*m* are inclined relative to the injection axis 300 at an inclination angle $\alpha 3$. The passage axes of the nozzle holes corresponding to the intersections 132*a*, 132*h* are inclined relative to the injection axis 300 at an inclination angle $\alpha 4$. The $\alpha 1$ to $\alpha 4$ have the relationship of: $\alpha 1>\alpha 2>\alpha 3>\alpha 4$. The inclination angles $\alpha 1$ to $\alpha 4$ respectively corresponding to the intersection groups are not necessarily the same in each group, and the values of the inclination angles may vary in each group within a specific range such that the inclination angles satisfy: $\alpha 1>\alpha 2>\alpha 3>\alpha 4$. The values of differences between the inclination angles of adjacent passage axes are substantially uniform when being viewing from the front side shown in FIG. 4B. That is, the values of differences have the relationship: $\alpha 1-\alpha 2 \div \alpha 2-\alpha 3 \div \alpha 3-\alpha 4$.

Figure 4C:
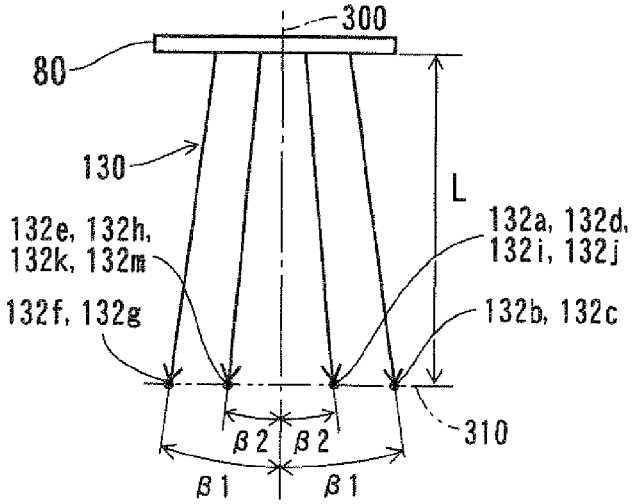
FIG. 4C is a view showing a lateral side of the nozzle plate when being viewed from the arrow IVC in FIG. 4B.

(8) FIG. 4C shows a lateral side when being viewed along the intercentral line 320. When the spray 130 is viewed from the lateral side in FIG. 4C, each of the intersections 132*b*, 132*c* intersects with the imaginary plane 310 substantially at the same position and the intersections 132*b*, 132*c* are grouped together into one intersection group. Similarly, the intersections 132*f*, 132*g*, the intersections 132*a*, 132*d*, 132*i*, 132*j*, and the intersections 132*e*, 132*h*, 132*k*, 132*m* are also grouped together respectively into insertion groups. When the spray 130 is viewed from the lateral side in FIG. 4C, the extension line of each passage axis shown by the arrow extends from each nozzle hole along the direction of fuel injection. The extension line corresponding to each intersection group extends along the direction of fuel injection and inclines at an inclination angle. The inclination angle becomes large as the intersection group becomes distant from the injection axis 300.

The intersections 132*b*, 132*c* and intersections 132*f*, 132*g* are distant from the injection axis 300 further than the intersections 132*a*, 132*d*, 132*i*, 132*j*and the intersections 132*e*, 132*h* 132*k*, 132*m*. The passage axes of the nozzle holes corresponding to the intersections 132*b*, 132*c* and the passage axes of the nozzle holes corresponding to the intersections 132*f*, 132*g* are inclined relative to the injection axis 300 substantially at the same inclination angle $\beta 1$. The passage axes of the nozzle holes corresponding to the intersections 132*a*, 132*d*, 132*i*, 132*j*, and the passage axes of the nozzle holes corresponding to the intersections 132*e*, 132*h* 132*k*, 132*m* are inclined relative to the injection axis 300 substantially at the same inclination angle $\beta 2$. The $\beta 1$ and the $\beta 2$ have the relationship of: $\beta 1>\beta 2$. The injection axis 300 is assumed as one passage axis, and the values of differences between the inclination angles of adjacent passage axes are substantially uniform when being viewing from the lateral side shown in FIG. 4C.

The fuel sprays can be restricted from crossing and interfering with each other by determining the inclination angle of fuel spray injected from each nozzle hole, as described in the clauses (7) and (8). Thereby, atomization of the fuel spray can be promoted.

In present embodiment, atomization of fuel spray can be promoted and distribution of injection quantity can be uniformed by employing the structures described in the clauses (5) to (8). Thus, mixture of fuel spray and air can be enhanced, and unburnt components such as HC can be reduced from exhaust gas.

Third to Twelfth Embodiments

The third to twelfth embodiments are described with reference to FIGS. 6 to 15. In each embodiment, the structure of the fuel injection valve other than the nozzle plate is substantially the same as the structure in the first embodiment. Components substantially equivalent to those of the above-described embodiments are denoted by the same letters.

In the third to twelfth embodiments, fuel sprays are injected in two directions, and each spray has outer intersections, which are located on a convex polygon or a circle on the outside, and at least one inner intersection, which is located inside the outer intersection. Thereby, distances of the fuel sprays injected from the nozzle holes can be possibly set large. Consequently, sprays can be restricted from interfering with each other, and atomization of the fuel sprays can be promoted. Furthermore, an injection quantity of each spray can be uniformly distributed in a cross section thereof, without being unbalanced, In FIGS. 6 to 13, one of the two sprays is depicted.

Third Embodiment

Figure 6:
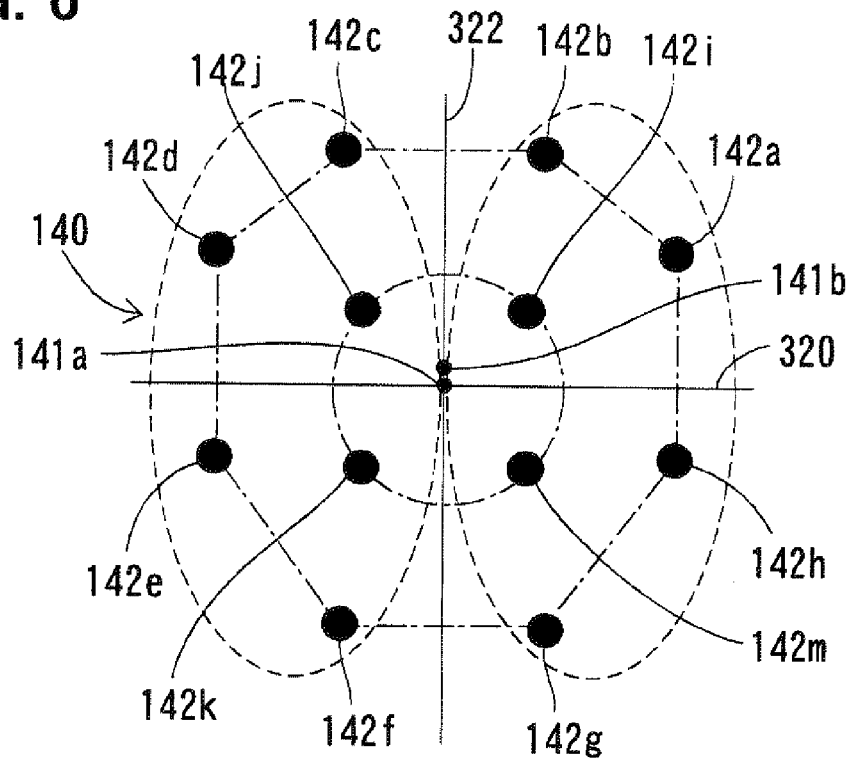
FIG. 6 is a view showing positions of intersections between the imaginary plane and passage axes of the nozzle holes, according to a third embodiment.

As shown in FIG. 6, in the third embodiment, a spray 140 has intersections 142*a*, 142*b*, 142*c*, 142*d*, 142*e*, 142*f*, 142*g*, 142*h*, which are located on vertexes of an octagon to define outer intersections, and intersections 142*i*, 142*j*, 142*k*, 142*m*, which are located on a substantially perfect circle to define inner intersections.

The intercentral lines 320 respectively pass through centers 141*a* of the two groups of the sprays 140. The orthogonal line 322 intersects perpendicularly to the intercentral lines 320. The orthogonal line 322 passes through centers 141*b* of the octagons defined by the intersections 142*a*, 142*b*, 142*c*, 142*d*, 142*e*, 142*f*, 142*g*, 142*h* as the outer intersections. The orthogonal line 322 is substantially in parallel with the imaginary plane 310. The intersections 142*c*, 142*d*, 142*e*, 142*f*, 142*j*, 142*k* and the intersections 142*b*, 142*a*, 142*h*, 142*g*, 142*i*, 142*m* are substantially axisymmetric to each other with respect to the orthogonal line 322. Thereby, the sprays 140 can be uniformly distributed in injection quantity on both sides with respect to the orthogonal line 322. Here, the twelve intersections of the spray 140 are not axisymmetric with respect to the intercentral line 320. The distance between two of the intersections 142*a*, 142*b*, 142*c*, 142*d*, 142*e*, 142*f*, 142*g*, 142*h* adjacent to each other on the octagon is not uniform. In the third embodiment, the position of the center 141*a* of the spray 140 is shifted relative to the center 141*b* of the outer intersection.

Fourth Embodiment

Figure 7:
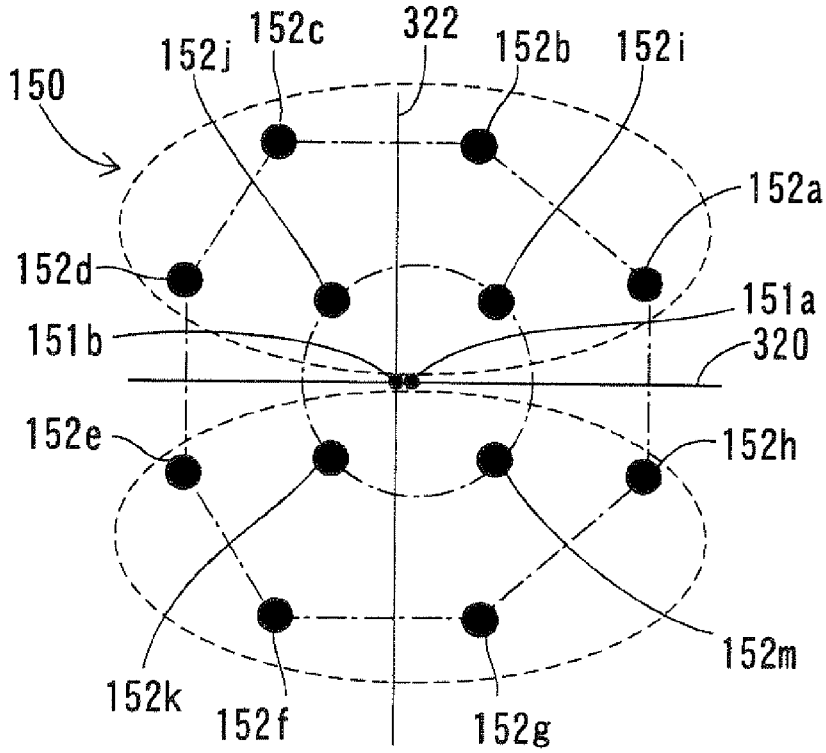
FIG. 7 is a view showing positions of intersections between the imaginary plane and passage axes of the nozzle holes, according to a fourth embodiment.

As shown in FIG. 7, in the fourth embodiment, a spray 150 has intersections 152*a*, 152*b*, 152*c*, 152*d*, 152*e*, 152*f* 152*g*, 152*h*, which are located on vertexes of an octagon to define outer intersections, and intersections 152*i*, 152*j*, 152*k*, 152*m*, which are located on a substantially perfect circle to define inner intersections.

The intersections 152*d*, 152*c*, 152*b*, 152*a*, 152*j*, 152*i* and the intersections 152*e*, 152*f*, 152*g*, 152*h*, 152*k*, 152*m* are substantially axisymmetric to each other with respect to the intercentral lines 320, which pass respectively through centers 151*a* of two groups of the spray 150. Thereby, the spray 150 can be uniformly distributed in injection quantity on both sides with respect to each intercentral line 320. Here, the twelve intersections of the spray 150 are not axisymmetric with respect to the orthogonal line 322, which intersects perpendicularly to the intercentral lines 320, and passes through centers 151*b* of the octagons defined by the intersections 152*a*, 152*b*, 152*c*, 152*d*, 152*e*, 152*f*, 152*g*, 152*h* as the outer intersections.

The distance between two of the intersections 152*a*, 152*b*, 152*c*, 152*d*, 152*e*, 152*f*, 152*g*, 152*h* adjacent to each other on the octagon is not uniform. In the fourth embodiment, the position of the center 151*a* of the spray 150 is shifted relative to the center 151*b* of the outer intersection.

Fifth Embodiment

Figure 8:
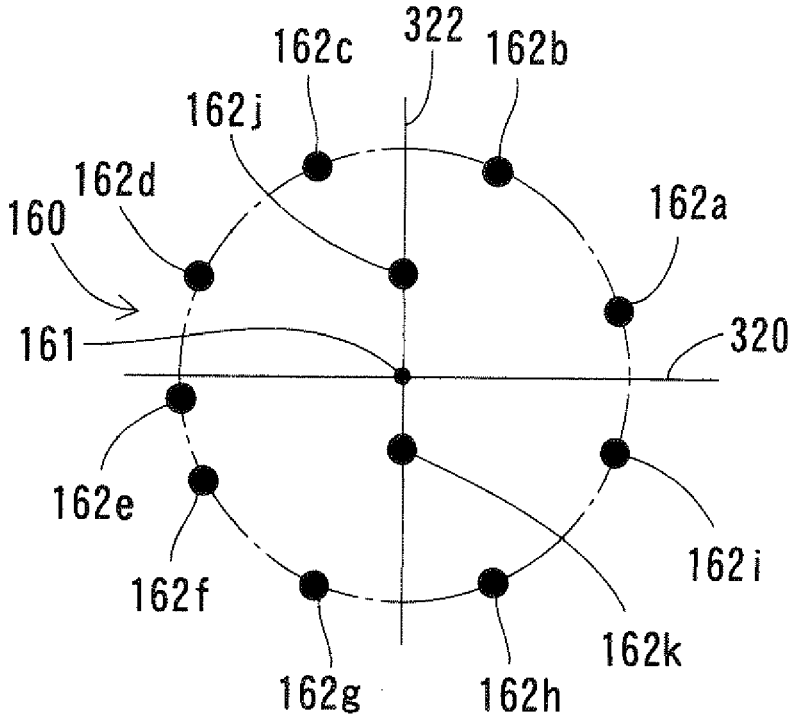
FIG. 8 is a view showing positions of intersections between the imaginary plane and passage axes of the nozzle holes, according to a fifth embodiment.
Figure 9:
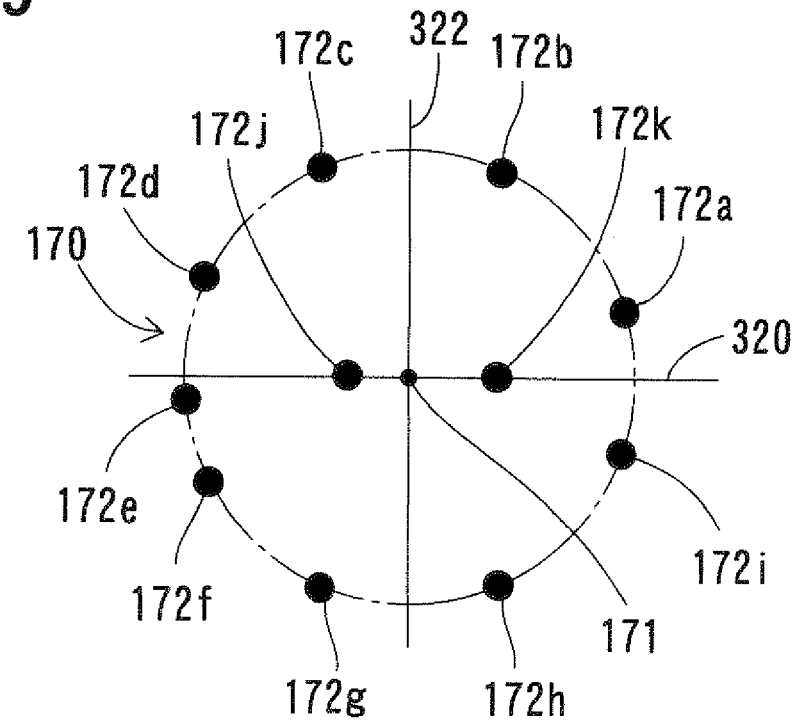
FIG. 9 is a view showing positions of intersections between the imaginary plane and passage axes of the nozzle holes, according to a sixth embodiment.

As shown in FIG. 8, in the firth embodiment, a spray 160 has intersections 162*a*, 162*b*, 162*c*, 162*d*, 162*e*, 162*f*, 162*g*, 162*h*, 162*i*, which are located on a substantially perfect circle to define outer intersections, and intersections 162*j*, 162*k*, which define inner intersections. The distance between two of the intersections 162*a*, 162*b*, 162*c*, 162*d*, 162*e*, 162*f*, 162*g*, 162*h*, 162*i* adjacent to each other on the substantially perfect circle is not uniform, The intersections 162*j*, 162*k* are on the orthogonal line 322 as a centerline passing through centers 161 of the intersections 162*a*, 162*b*, 162*c*, 162*d*, 162*e*, 162*f*, 162*g*, 162*i* as the outer intersections. Thereby, the distance between each of the outer intersections on one side with respect to the orthogonal line 322 and each of the intersections 162*j*, 162*k* on the orthogonal line 322 can be balanced with the distance between each of the outer intersections on other side with respect to the orthogonal line 322 and each of the intersections 162*j*, 162*k*, That is, distribution of the outer intersections can be balanced with respect to the orthogonal line 322 on which the intersections 162*j*, 162*k* are located. Thereby, the spray 160 can be uniformly distributed in injection quantity.

Sixth Embodiment

As shown in FIG, 9, in the sixth embodiment, a spray 170 has intersections 172*a*, 172*b*, 172*c*, 172*d* 172*e*, 172*f*, 172*g*, 172*h*, 172*i*, which are located on a substantially perfect circle to define outer intersections, and intersections 172*j*, 172*k*, which define inner intersections. The distance between two of the intersections 172*a*, 172*b*, 172*c*, 172*d*, 172*e*, 172*f*, 172*g*, 172*h*, 172*i* adjacent to each other on the substantially perfect circle is not uniform.

The intersections 172*j*, 172*k* are located on centerlines of the outer intersections, and the centerlines correspond to the intercentral lines 320 respectively pass through centers 171 of the two groups of the sprays 170. Thereby, the distance between each of the outer intersections on one side with respect to the intercentral lines 320 and each of the intersections 172*j*, 172*k* on the intercentral lines 320 can be balanced with the distance between each of the outer intersections on other side with respect to the orthogonal line 322 and each of the intersections 172*j*, 172*k*. Thereby, distribution of the outer intersections. can be balanced with respect to the intercentral lines 320 on which the intersections 172*j*, 172*k* are located. Thereby, the spray 170 can be uniformly distributed in injection quantity.

Seventh Embodiment

Figure 10:
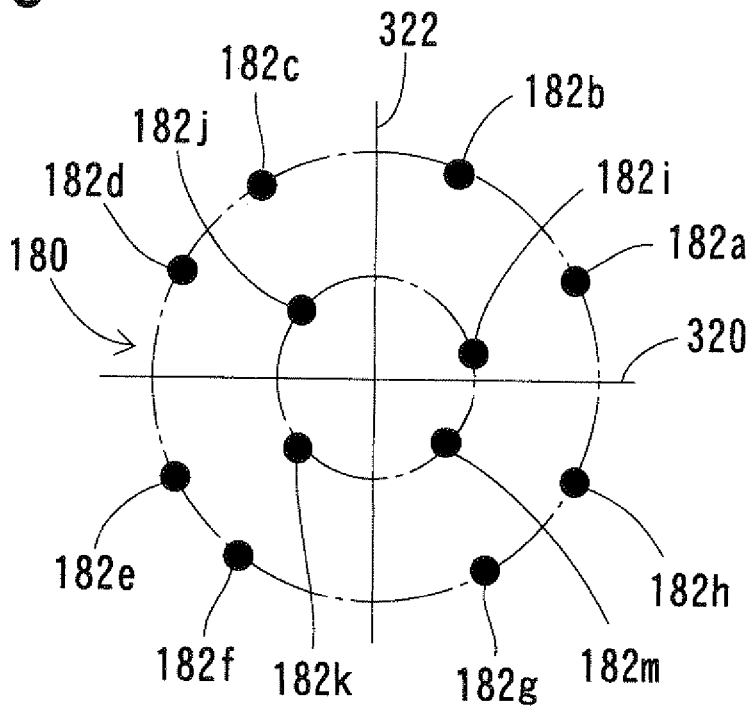
FIG. 10 is a view showing positions of intersections between the imaginary plane and passage axes of the nozzle holes, according to a seventh embodiment.

As shown in FIG. 10, in the fourth embodiment, a spray 180 has intersections 182*a*, 182*b*, 182*c*, 183*d*, 183*e*, 182*f*, 182*g*, 182*h*, which are located on a substantially perfect circle to define outer intersections, and intersections 182*i*, 182*j*, 182*k*, 182*m*, which are located on a substantially perfect circle to define inner intersections. The distance between two of the intersections 182*a*, 182*b*, 182*c*, 182*d*, 182*e*, 182*f*, 182*g*, 182*h* adjacent to each other on the substantially perfect circle is not uniform. The distance between two of the intersections 182*i*, 182*j*, 182*k*, 182*m* adjacent to each other on the substantially perfect circle is not uniform. The distance between one of the intersections 182*i*, 182*j*, 182*k*, 182*m* and adjacent one of the outer intersections is not uniform.

Eighth Embodiment

Figure 11:
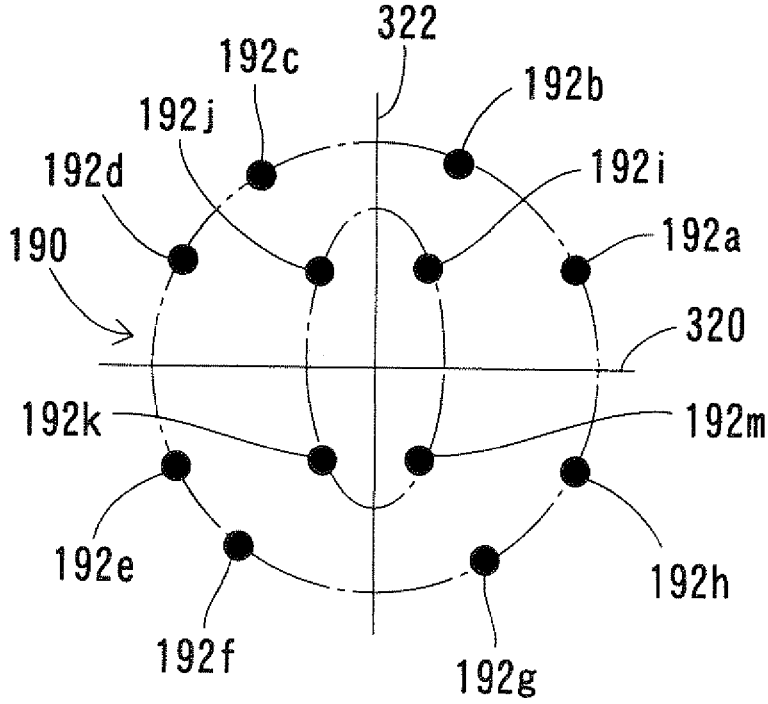
FIG. 11 is a view showing positions of intersections between the imaginary plane and passage axes of the nozzle holes, according to an eighth embodiment.

As shown in FIG. 11, in the eighth embodiment, a spray 190 has intersections 192*a*, 192*b*, 192*c*, 192*d*, 192*e*, 192*f*, 192*g*, 192*h*, which are located on a substantially perfect circle to define outer intersections, and intersections 192*i*, 192*j*, 192*k*, 192*m*, which are located on a substantially ellipse to define inner intersections. The distance between two of the intersections 192*a*, 192*b*, 192*c*, 192*d*, 192*e*, 192*f*, 192*g*, 192*h* adjacent to each other on the substantially perfect circle is not uniform. The distance between two of the intersections 192*i*, 192*j*, 192*k*, 192*m* adjacent to each other on the substantially ellipse is not uniform, The distance between one of the intersections 192*i*, 192*j*, 192*k*, 192*m* and adjacent one of the outer intersections is not uniform.

Ninth Embodiment

Figure 12:
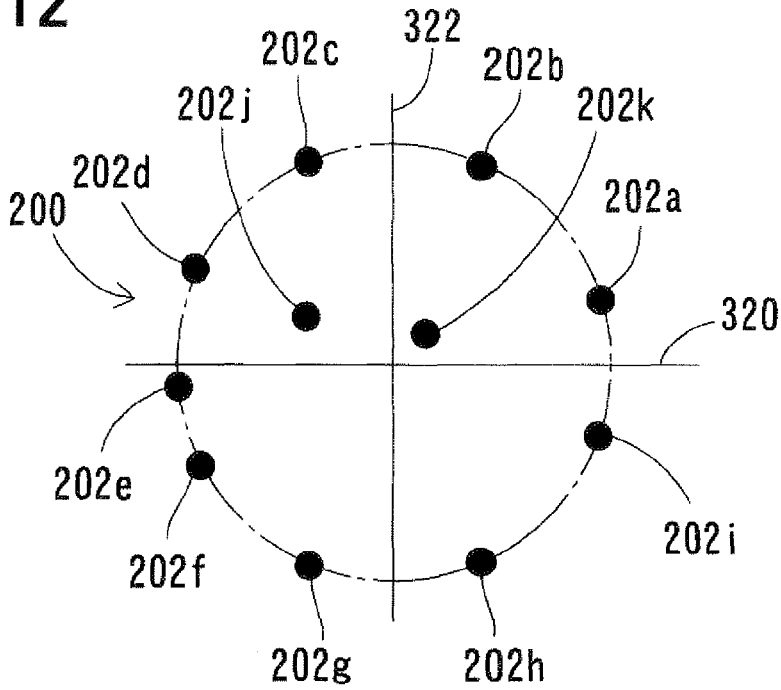
FIG. 12 is a view showing positions of intersections between the imaginary plane and passage axes of the nozzle holes, according to a ninth embodiment.

As shown in FIG. 12, in the ninth embodiment, a spray 200 has intersections 202*a*, 202*b*, 202*c*, 202*d*, 202*e*, 202*f*, 202*g*, 202*h*, 202*i*, which are located on a substantially perfect circle to define outer intersections, and intersections 202*j*, 202*k*, which define inner intersections. The distance between two of the intersections 202*a*, 202*b*, 202*c*, 202*d*, 202*e*, 202*f*, 202*g*, 202*h*, 202adjacent to each other on the substantially perfect circle is not uniform. The distance between one of the intersections 202*i*, 202*j* and adjacent one of the outer intersections is not uniform.

Tenth Embodiment

Figure 13:
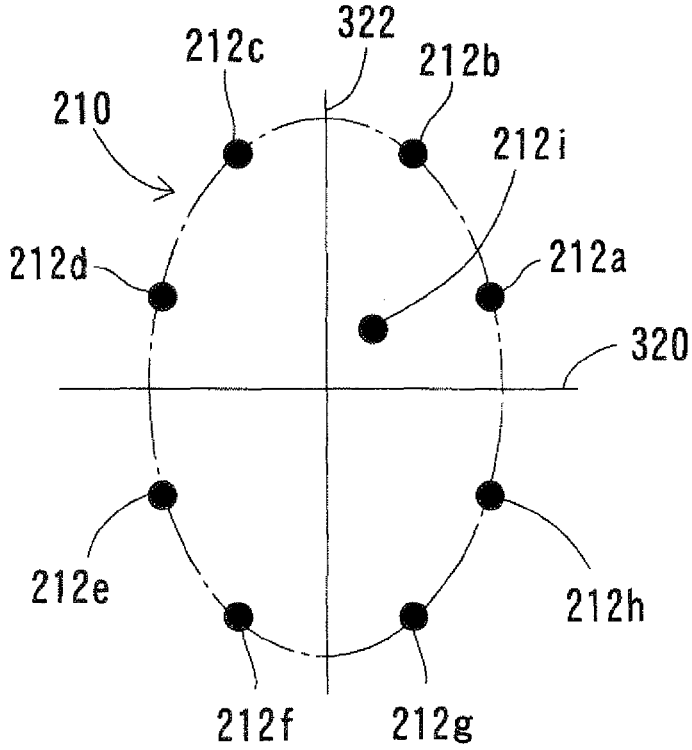
FIG. 13 is a view showing positions of intersections between the imaginary plane and passage axes of the nozzle holes, according to a tenth embodiment.

As shown in FIG. 13, in the tenth embodiment, a spray 210 has intersections 212*a*, 212*b*, 212*c*, 212*d*, 212*e*, 212*f* 212*g*, 212*h*, which are located on a substantially ellipse to define outer intersections, and an intersection 212*i*, which define inner intersection. The distance between two of the intersections 212*a*, 212*b*, 212*c*, 212*d*, 212*e*, 212*f*, 212*g*, 212*h* adjacent to each other on the substantially ellipse is not uniform. The distance between the intersection 212*i* and one of the outer intersections is not uniform.

Eleventh Embodiment

Figure 14A:
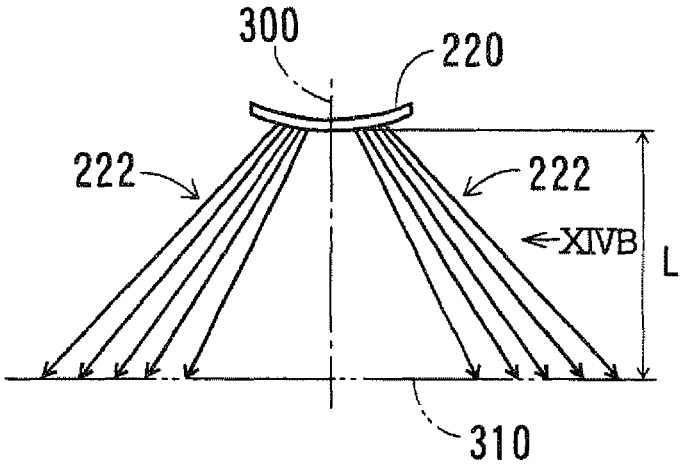
FIG. 14A is a view showing a front side of the nozzle plate according to a eleventh embodiment.
Figure 14B:
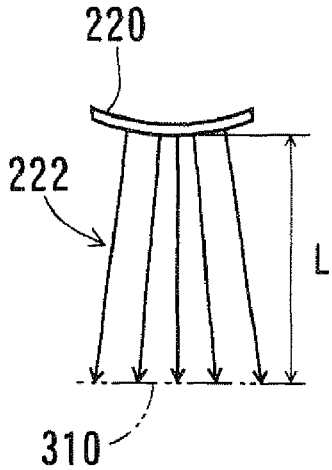
FIG. 14B is a view showing a lateral side of the nozzle plate when being viewed from the arrow XIVB in FIG. 14A.

As shown in FIG. 14, in the eleventh embodiment, a nozzle plate 220 is provided to form sprays 222 in two directions, and the nozzle plate 220 is bent to be in a convex shape to determine the inclination angles of the nozzle holes in the nozzle plate 220 and the injection directions of the nozzle plate 220.

Twelfth Embodiment

Figure 15A:
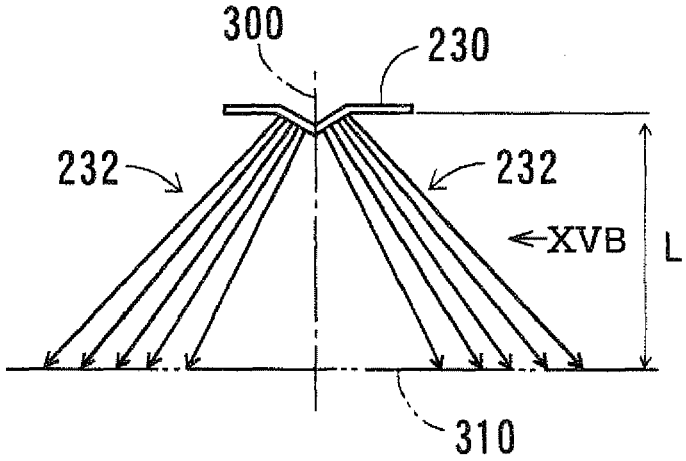
FIG. 15A is a view showing a front side of the nozzle plate according to a twelfth embodiment.
Figure 15B:
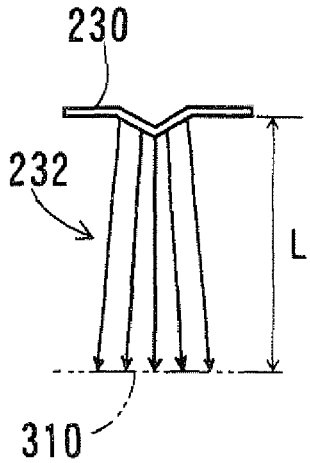
FIG. 15B is a view showing a lateral side of the nozzle plate when being viewed from the arrow XVB in FIG. 15A.

As shown in FIG. 15, in the twelfth embodiment, a nozzle plate 230 is provided to form sprays 232 in two directions, and the nozzle plate 230 has a nozzle portion, which defines the nozzle holes, and is substantially in a conical shape. The nozzle portion is protruded to determine the inclination angles of the nozzle holes and the injection directions of the nozzle plate 230.

According to the above embodiments, the imaginary plane intersects perpendicularly with the injection axis of the nozzle device. The imaginary plane is at the predetermined distance from the nozzle device with respect to the injection direction. The imaginary straight lines are respectively extended in the directions of the fuel injections along the passage axes of the nozzle holes, The intersections between the imaginary plane and the imaginary straight lines include the multiple outer intersections and the at least one inner intersection in at least one group of multiple groups of sprays. The inclination angles of the nozzle holes are determined such that: the outer intersections are located on the convex polygon, which is outwardly convex, or the circle; and the at least one inner intersection is located inside the outer intersections. Here, the circle includes a substantially perfect circle and an ellipse.

In this manner, fuel is injected from the nozzle holes such that the at least one inner intersection is located inside the outer intersections, in addition to that the outer intersections are located on the convex polygon or the circle. Thus, the distance of the fuel sprays injected from the nozzle holes can be possibly kept apart from each other. Consequently, sprays can be restricted from interfering with each other, and atomization of the fuel sprays can be promoted.

Furthermore, since fuel is injected from the nozzle holes such that the at least one inner intersection is located inside the outer intersections, the deviation in distribution of the injection quantity in the cross section of the spray can be reduced.

According to the above embodiment, all the at least one inner intersection is located on the one centerline, which extends along the imaginary plane through the center of the convex polygon or the circle, which is defined by the outer intersections. Therefore, the inner intersection can be restricted from being too close to the outer intersections located on both sides with respect to the centerline. Consequently, the sprays corresponding to the outer intersections and the spray corresponding to the at least one inner intersection can be restricted from interfering with each other. Thus, atomization of the fuel sprays can be promoted. Furthermore, the injection quantity of each spray can be uniformly distributed in the cross section thereof, without being unbalanced.

According to the above embodiment, the number of the at least one inner intersection may be one. In this case, the one inner intersection may be substantially located at the center of the convex polygon or the circle. In this configuration, the distance between the one inner intersection and each of the outer intersections is substantially uniform. Thereby, the sprays corresponding to the outer intersections and the spray corresponding to the one inner intersection can be restricted from interfering with each other. Thus, atomization of the fuel sprays can be promoted. Furthermore, the injection quantity of each spray can be uniformly distributed in the cross section thereof, without being unbalanced.

According to the above embodiment, the inner intersection may be located substantially on the center of a convex polygon or a substantially circle, which is coaxial with the convex polygon or the circle defined by the outer intersection. In this configuration, deviation in the distance between the inner intersection and one of the outer intersections can be reduced. Thereby, the sprays corresponding to the outer intersections and the spray corresponding to the one inner intersection can be restricted from interfering with each other. Thus, atomization of the fuel sprays can be promoted. Furthermore, the injection quantity of each spray can be uniformly distributed in the cross section thereof, without being unbalanced.

According to the above embodiment, the distance between two of the outer intersections adjacent to each other with respect to the circumferential direction thereof may be uniform. In this configuration, the fuel sprays corresponding to the outer intersections can be restricted from interfering with each other. Thereby, atomization of the fuel spray can be promoted. Furthermore, the injection quantity of each spray corresponding to the outer intersections can be uniformly distributed, without being unbalanced.

In the above embodiment, the number of the outer intersections may be an integral multiple of the number of inner intersections. In this case, the distance between each point of the inner intersection and each of the outer intersections close to each other is substantially uniform.

Thereby, the sprays corresponding to the outer intersections and the spray corresponding to the at least one inner intersection can be restricted from interfering with each other. Thus, atomization of the fuel sprays can be promoted. Furthermore, the injection quantity of each spray can be uniformly distributed in the cross section thereof, without being unbalanced.

In the above embodiment, the intercentral line may pass through the centers of the two sprays in the imaginary plane. The orthogonal line may pass through each center of the convex polygon or circle and may intersect perpendicularly with the intercentral line. In this case, the outer intersections and the inner intersection may be substantially axisymmetric with respect to the orthogonal line. In this configuration, distribution of the injection quantity becomes substantially uniform on both sides of the orthogonal line.

According to the above embodiment, the imaginary plane and the passage axes of the nozzle holes may intersect at substantially the same position in one intersection group when being viewed from the front side. The injection axis passes through the center of the nozzle device in the thickness direction. The passage axes are inclined at the inclination angle to be away from the injection axis toward the injection direction. In this configuration, as the intersection group becomes distant from the injection axis, the inclination angle of the passage axes corresponding to the intersection group may become large. Thus, sprays injected from the nozzle holes can be restricted from interfering with each other, and atomization of the fuel sprays can be promoted.

In this configuration, the difference between the inclination angles of the adjacent passage axes may be substantially uniform when being viewed from the front side. In this case, the fuel sprays injected from the nozzle holes can be restricted from intersecting with each other. Thereby, atomization of the fuel spray can be promoted.

In the above embodiment, the outer intersections and the inner intersection may be substantially axisymmetric with respect to the intercentral line passing along the imaginary plane through the centers of the two sprays. In this configuration, distribution of the injection quantity becomes substantially uniform on both sides with respect to the intercentral line.

According to the above embodiment, the imaginary plane and the passage axes of the nozzle holes may intersect at substantially the same position in one intersection group when being viewed from the lateral side. The injection axis passes through the center of the nozzle device in the thickness direction, The passage axes are inclined at the inclination angle to be away from the injection axis toward the injection direction. In this configuration, as the intersection group becomes distant from the injection axis, the inclination angle of the passage axes corresponding to the intersection group may become large. In this case, sprays injected from the nozzle holes can be restricted from interfering with each other, and atomization of the fuel sprays can be promoted.

In the above embodiment, the difference between the inclination angles of the adjacent passage axes may be substantially uniform when being viewed from the lateral side in a case where the injection axis is assumed to by one passage axis. In this case, the fuel sprays injected from the nozzle holes can be restricted from intersecting with each other. Thereby, atomization of the fuel spray can be promoted.

Other Embodiment

Figure 16:
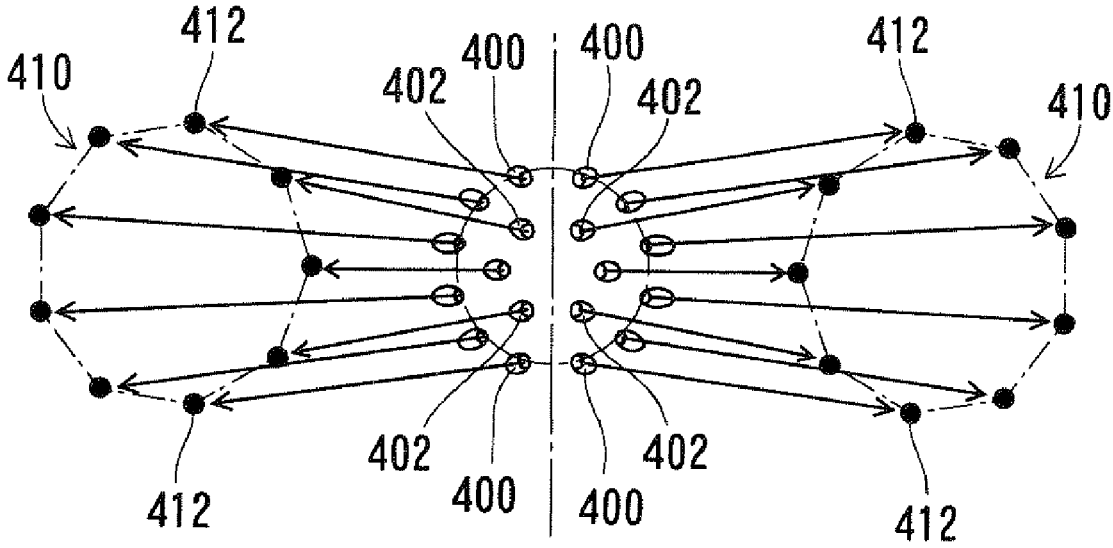
FIG. 16 is a view showing a nozzle plate when being viewed from outside injection nozzle holes according to one related art.
Figure 17:
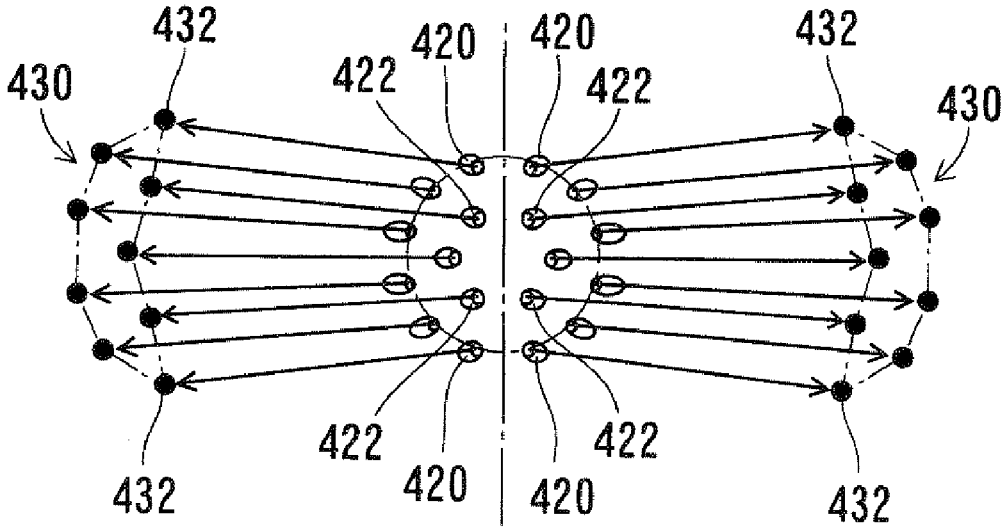
FIG. 17 is a view showing a nozzle plate when being viewed from outside injection nozzle holes according to another related art.

In each of the above embodiments, the inclination angles of the nozzle holes are determined such that the outer intersections exist in the convex polygon or the circle on the outside, and at least one inner intersection exists inside the outer intersections in both the two-way sprays in the two directions. Alternatively, the inclination angles of the nozzle holes may be determined such that an inner intersection does not exist in one of the two-way sprays, similarly to one of the sprays shown in FIGS. 16, 17. The number of the directions of the fuel injections is not limited to two. Fuel may be injected in three or more directions to form three or more groups of sprays.

In the above embodiments, the nozzle device is applied to the fuel injection valve of the gasoline engine. Alternatively, the nozzle device may be applied to any other fuel injection valves used for atomizing and injecting fuel.

The nozzle device is not limited to being applied to a fuel injection valve, and may be applied to an injection apparatus for any other fluid such as ink.

In this manner, the invention is not limited to the embodiments described above but is applicable to various embodiments within a scope not departing from the gist thereof. For example, features of the above embodiments may be arbitrary combined.

What is claimed is:

1. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein every inner intersection is located on a single intercentral line, which extends along the imaginary plane through a center of the first polygon or the first circle defined by the outer intersection.

2. The nozzle device according to claim 1, wherein the at least one inner intersection includes one inner intersection, and the one inner intersection is located in the center of the first polygon or the first circle.

3. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray croups, the imaainary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein all the at least one inner intersection is located on a second polygon, which is outwardly convex, or a second circle, which is coaxial with the first polygon or the first circle.

4. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein every two of the plurality of outer intersections, which are circumferentially adjacent to each other, are at a distance from each other, and the distance is substantially uniform.

5. The nozzle device according to claim 4, wherein a number of the plurality of outer intersections is an integral multiple of a number of the at least one inner intersection, and a distance between each of the at least one inner intersection and each of the plurality of outer intersections, which is close to the each of the at least one inner intersection, is substantially uniform.

6. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein the plurality of sprays are grouped into two spray groups respectively injected in two injection directions, the two spray groups respectively have centers through which intercentral lines pass in the imaginary plane, the intercentral lines intersect perpendicularly with an orthogonal line that passes through a center of the first polygon or the first circle, and the plurality of outer intersections and the at least one inner intersection are substantially axisymmetric with respect to the orthogonal line.

7. The nozzle device according to claim 6, wherein the plurality of sprays are grouped into two spray groups respectively injected in two injection directions, the intercentral lines pass through the centers of the two spray groups in the imaginary plane, the passage axes are correspondingly grouped into a plurality of intersection groups each intersect with the imaginary plane substantially at the same position when the plurality of sprays is viewed from a front side perpendicularly to the intercentral lines and along the imaginary plane, the passage axes are inclined at the inclination angles to be away from the injection axis toward the injection directions, and the inclination angle of one of the passage axes, which corresponds to one of the plurality of intersection groups, is greater than the inclination angle, which corresponds to any one of the other of the intersection groups being closer to the injection axis than the one intersection group.

8. The nozzle device according to claim 7, wherein a difference between the inclination angles of the adjacent passage axes is substantially uniform when being viewed from the front side.

9. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein the plurality of sprays are grouped into two spray groups respectively injected in two injection directions, the plurality of outer intersections and the at least one inner intersection are substantially axisymmetric with respect to intercentral lines passing through the centers of the two spray groups in the imaginary plane, the plurality of sprays are grouped into two spray groups respectively injected in two injection directions, the intercentral lines pass through the centers of the two spray groups in the imaginary plane, the passage axes are correspondingly grouped into a plurality of intersection groups each intersect with the imaginary plane substantially at the same position when the plurality of sprays is viewed from a lateral side along the intercentral lines, the passage axes are inclined at the inclination angles to be away from the injection axis toward the injection directions, and the inclination angle of one of the passage axes, which corresponds to one of the plurality of intersection groups, is greater than the inclination angle, which corresponds to any one of the other of the intersection groups being closer to the injection axis than the one intersection group.

10. The nozzle device according to claim 9 wherein a difference between the inclination angles of the adjacent passage axes is substantially uniform when being viewed from the lateral side in a condition where the injection axis is assumed to be one passage axis.

11. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein the plurality of sprays are grouped into two spray groups respectively injected in two injection directions, the two spray groups respectively have centers through which intercentral lines pass in the imaginary plane, and the nozzle portion is bent to be substantially in a convex shape to determine the inclination angles of the nozzle holes and the injection directions when being viewed perpendicularly to the intercentral lines and along the imaginary plane from a front side.

12. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein the plurality of sprays are grouped into two spray groups respectively injected in two injection directions, the two spray groups respectively have centers through which intercentral lines pass in the imaginary plane, and the nozzle portion is protruded substantially in a conical shape to determine the inclination angles of the nozzle holes and the injection directions when being viewed perpendicularly to the intercentral lines and along the imaginary plane from a front side.

13. A fuel injection valve comprising:

a valve body having an inner periphery defining a fuel passage and a valve seat;

a valve element adapted to blocking the fuel passage by being seated to the valve seat and adapted to opening the fuel passage by being lifted from the valve seat; and a nozzle device being substantially in a plate-shape and provided downstream of the valve seat for injecting fuel flowing out of the fuel passage, wherein the nozzle device includes a nozzle portion having a plurality of nozzle holes for injecting a plurality of sprays grouped into a plurality of spray groups respectively injected in injection directions different from each other, the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein for at least two of the spray groups, the imaginary plane and the imaginary lines of each said spray group have intersections defining a plurality of outer intersections that respectively define for each said spray group a first polygon, which is outwardly convex, or first circle, and the imaginary plane and the imaginary lines of at least one of said two spray groups further define at least one inner intersection disposed inside the plurality of outer intersections.

14. The fuel injection valve according to claim 13, wherein the imaginary plane and the imaginary lines of both of said two spray groups further define at least one inner intersection disposed inside the plurality of outer intersections.

15. A nozzle device being substantially in a plate-shape, the nozzle device comprising:

a nozzle portion having a plurality of nozzle holes for injecting a plurality of sprays grouped into a plurality of spray groups respectively injected in injection directions different from each other, wherein the nozzle portion has an injection axis extending through a center of the nozzle portion in a thickness direction of the nozzle portion, the injection axis perpendicularly intersects with an imaginary plane, which is at a predetermined distance from the nozzle portion in the injection directions, the plurality of nozzle holes of each of the plurality of spray groups respectively have passage axes from which imaginary lines respectively extend in the injection directions, the imaginary plane and the imaginary lines respectively intersect, defining a plurality of intersections, and each of the plurality of nozzle holes is inclined at an inclination angle being determined in such a manner that:

for at least one of the spray groups, the imaginary plane and the imaginary lines of said spray group have intersections respectively defining a plurality of outer intersections and at least one inner intersection, the plurality of outer intersections define a first polygon, which is outwardly convex, or a first circle, and the at least one inner intersection is disposed inside the plurality of outer intersections, wherein for at least two of the spray groups, the imaginary plane and the imaginary lines of each said spray group have intersections defining a plurality of outer intersections that respectively define for each said spray group a first polygon, which is outwardly convex, or first circle, and the imaginary plane and the imaginary lines of at least one of said two spray groups further define at least one inner intersection disposed inside the plurality of outer intersections, wherein the imaginary plane and the imaginary lines of each of at least two of the plurality of spray groups have intersections defining a plurality of outer intersections and at least one inner intersection.

16. The nozzle device according to claim 15, wherein the imaginary plane and the imaginary lines of both of said two spray groups further define at least one inner intersection disposed inside the plurality of outer intersections.

* * * * *